US006306042B1

(12) United States Patent
Tortul

(10) Patent No.: US 6,306,042 B1
(45) Date of Patent: Oct. 23, 2001

(54) PHASE VARIATOR WITH MOVEMENT LIMIT DEVICES

(75) Inventor: Renzo Tortul, S. Pier D'Isonzo (IT)

(73) Assignee: Carraro S.p.A., Padua (IT)

( * ) Notice: Subject to any disclaimer, the term of this patent is extended or adjusted under 35 U.S.C. 154(b) by 0 days.

(21) Appl. No.: 08/679,485

(22) Filed: Jul. 12, 1996

(51) Int. Cl.[7] ..... F16D 3/10; F01L 1/344

(52) U.S. Cl. ..... 464/2; 464/158; 123/90.17; 123/90.15

(58) Field of Search ..... 464/1, 2, 16, 158; 123/90.17, 90.31, 90.15

(56) References Cited

U.S. PATENT DOCUMENTS 5,150,671 * 9/1992 Suga ..... 464/2 X
5,201,289 * 4/1993 Imai ..... 123/90.31 X
5,263,442 * 11/1993 Hara ..... 464/2 X
5,386,807 * 2/1995 Linder ..... 123/90.17
5,435,782 * 7/1995 Tortul ..... 464/2
5,483,930 * 1/1996 Moriya et al. ..... 464/2 X

FOREIGN PATENT DOCUMENTS 0571023 11/1993 (EP) .
9324736 5/1993 (WO) .

* cited by examiner

*Primary Examiner*—Gregory J. Strimbu
(74) *Attorney, Agent, or Firm*—Sughrue, Mion, Zinn, Macpeak & Seas, PLLC

(57) ABSTRACT

A phase variator including a piston actuator slidable between two travel limit positions as a result of the supply of a flow of pressurized fluid to at least one chamber of the variator. Valves are provided in the variator for choking the flow associated with the at least one chamber so as to avoid axial end contact of the piston and casing and axial end contact of the piston and hub.

17 Claims, 6 Drawing Sheets

PHASE VARIATOR WITH MOVEMENT LIMIT DEVICES

BACKGROUND OF THE INVENTION

The present invention relates to a phase variator for varying the phase relationship between a shaft and a transmission associated therewith, of the type comprising:

a hub fixed for rotation with the shaft, a casing fixed for rotation with the transmission, an annular space defined between the casing and the hubs an annular piston mounted in the space and defining therein at least one supply chamber for a pressurized servo means, supply means for supplying a flow of the pressurized servo means into the chamber, the piston covering the hub, being translatable axially thereon, and being movable in the space as a result of the supply of the flow to the chamber and against an opposing force, toothed coupling means arranged between the hub and the annular piston as well as between the annular piston and the casing so as to bring about a variation of the relative angular positions of the hub and of the casing as a result of the axial movement of the piston relative to the hub; and stop means for stopping the piston in at least one predetermined position relative to the casing and to the hub.

These variators are used in internal combustion engines for modifying the phase relationship between the camshaft and the engine shaft by means of an axial displacement of the piston between two predetermined travel limit positions relative to the hub and to the casing. To ensure that the piston can slide on the teeth of the casing and of the hub, sufficient clearance must be provided between these sets of teeth. Owing to this clearance and to the alternating load which is exerted on the variator as a result of torque reversals due to the action of the valve springs on the cams of the camshaft, a "knocking" effect is produced between the piston, the casing and the hub and causes the variator to be quite noisy in operation.

In particular, there is circumferential knocking between the sides of the meshed teeth and axial knocking between the piston and the mechanical stop abutments which limit its travel owing, respectively, to the tangential and axial components of the forces transmitted by the teeth.

To limit this noise, British patent No. 2,228,780 provides for the rotation of the casing relative to the hub to be limited to a predetermined angle so that the piston is stopped by wedging of the respective teeth before the piston has abutted the casing in the respective travel limit positions.

European patent application No. 491,410 describes a phase variator in which the piston can be stopped in a position intermediate the travel limit positions by the opening of a discharge hole which is choked by the piston so that the force acting on the two axially opposed faces of the piston are balanced.

However, this solution involves the entire flow of pressurized oil continuously being supplied to the variator and delivered to the exhaust. In practice, the solution is unsuitable for operation with limited oilflows.

Moreover, there are no measures for attenuating or eliminating axial knocking of the piston in the travel limit positions.

SUMMARY OF THE INVENTION

The problem upon which the present invention is based is that of providing a phase variator which is designed structurally and functionally so as to avoid all of the problems complained of with reference to the prior art mentioned.

This problem is solved by the invention by means of a phase variator of the type mentioned at the beginning, characterized in that the stop means comprise valve means for choking the flow of the servo means delivered to the chamber, the valve means being such as to choke the flow so as to balance the opposing force on the piston.

DESCRIPTION OF THE DRAWINGS

The invention will now be described in greater detail with reference to four preferred embodiments thereof, illustrated by way of non-limiting example, in the appended drawings, in which.

DETAILED DESCRIPTION OF THE INVENTION

Figure 1:
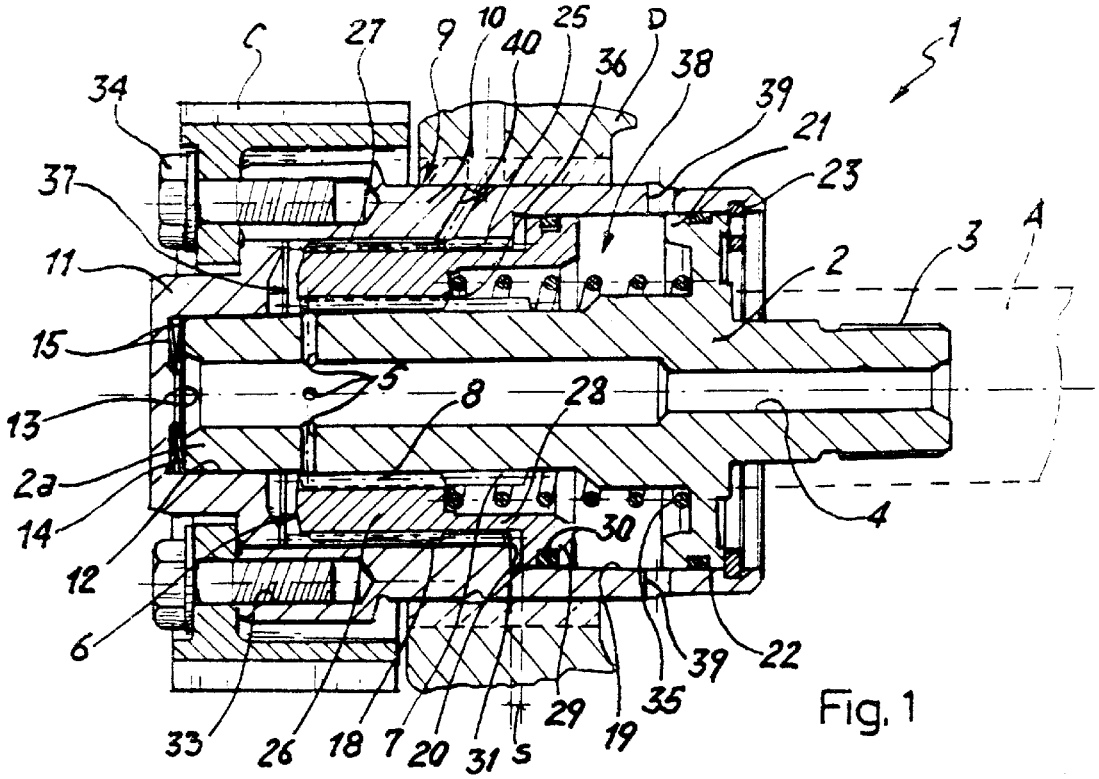
FIG. 1 is an axial section of a first embodiment of the phase variator according to the invention, in the first travel limit position.
Figure 2:
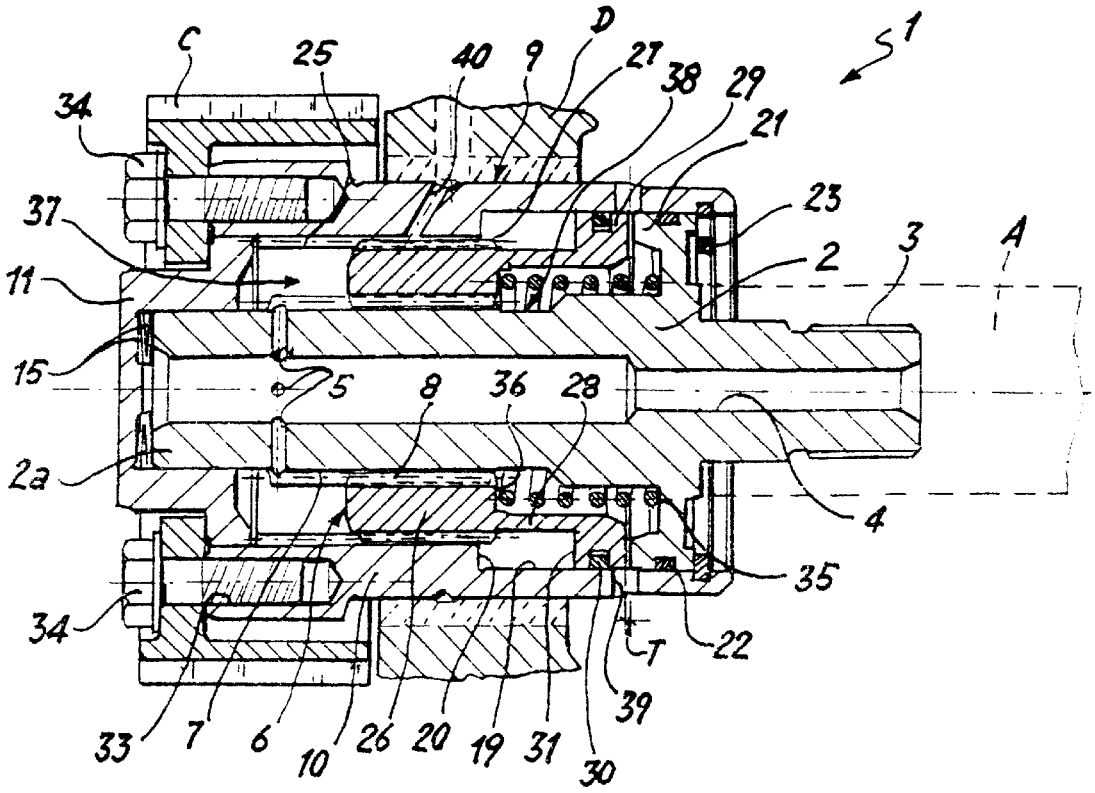
FIG. 2 is an axial section of a first embodiment of the phase variator according to the invention, in the second travel limit position.
Figure 3:
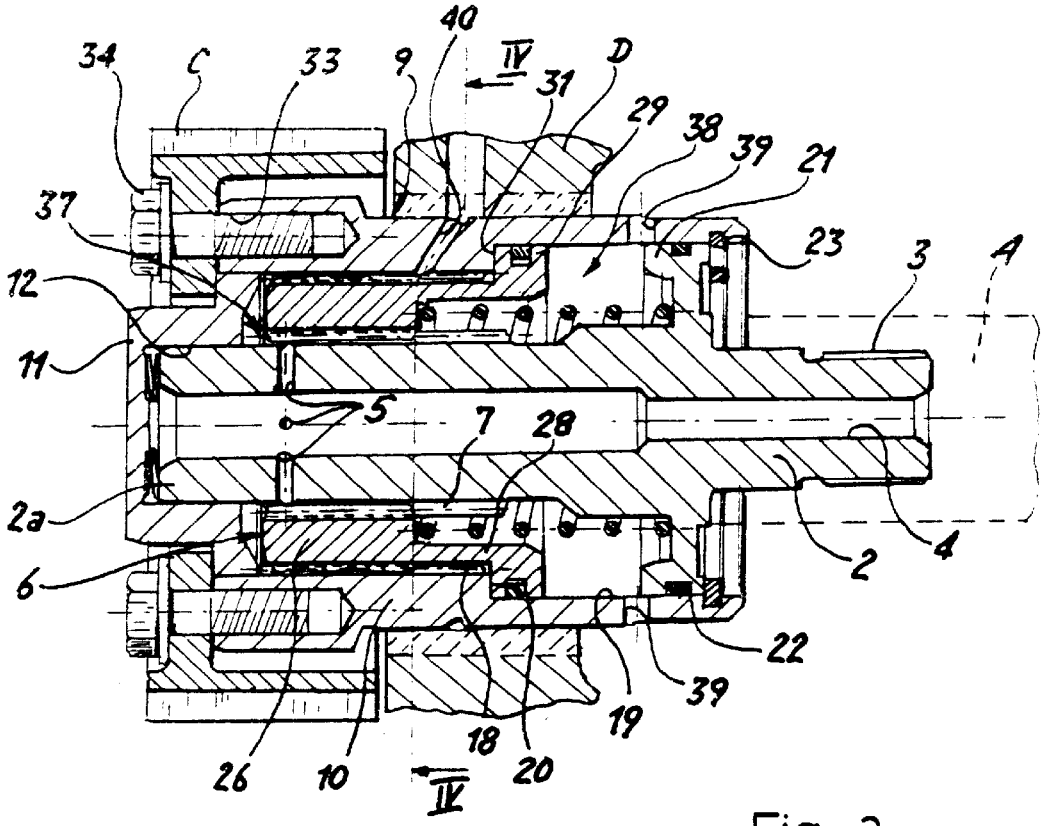
FIG. 3 is an axial section of a first embodiment of the phase variator in a non-operative condition, such as when the engine is not operating.
Figure 4:
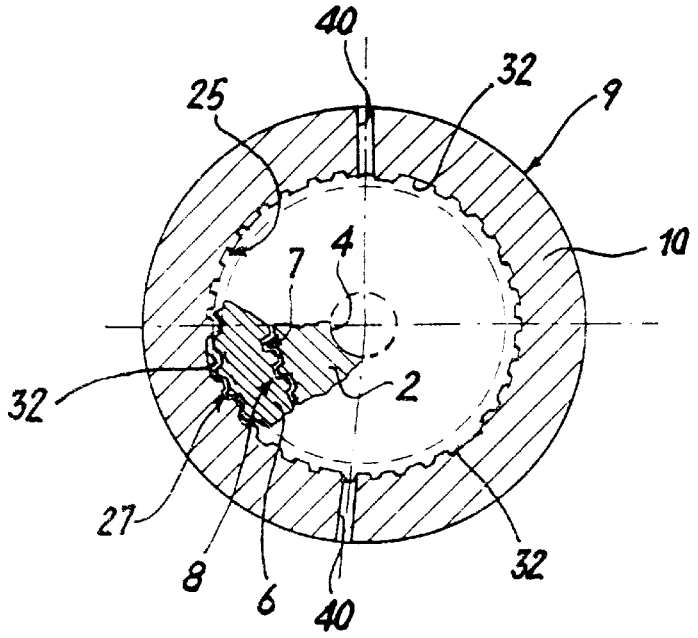
FIG. 4 is a section taken on the line IV—IV of FIG. 3.
Figure 5:
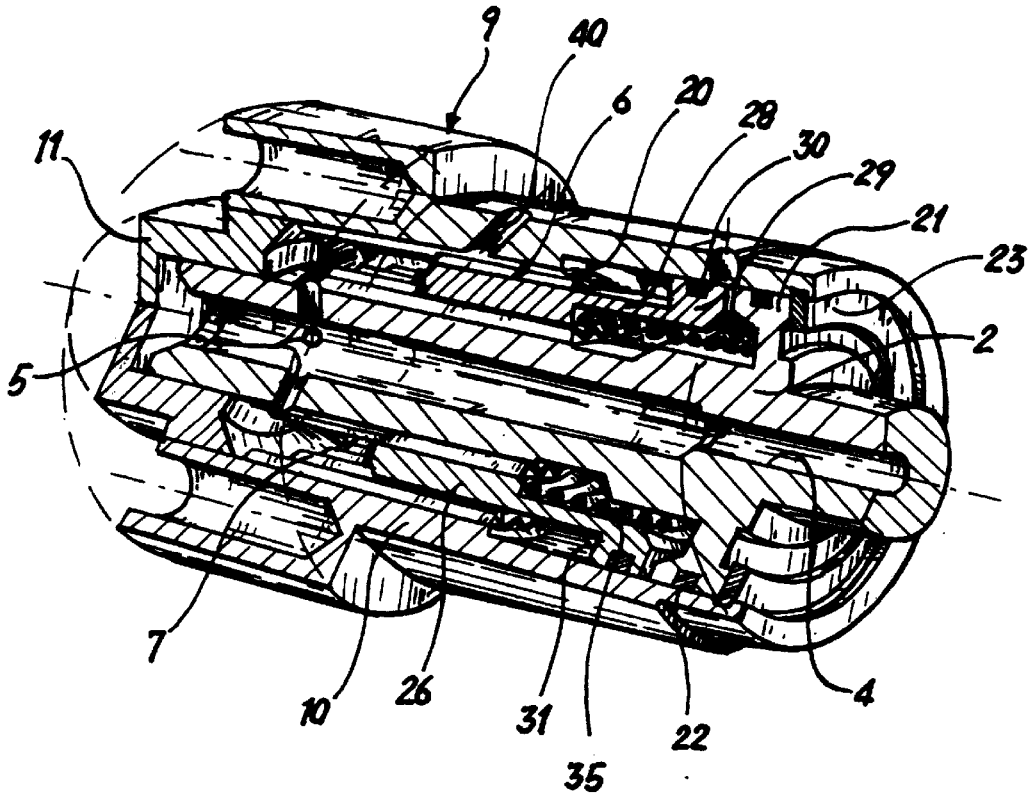
FIG. 5 is a partially-sectioned, perspective view of a detail of the variator of the preceding drawings.
Figure 12:
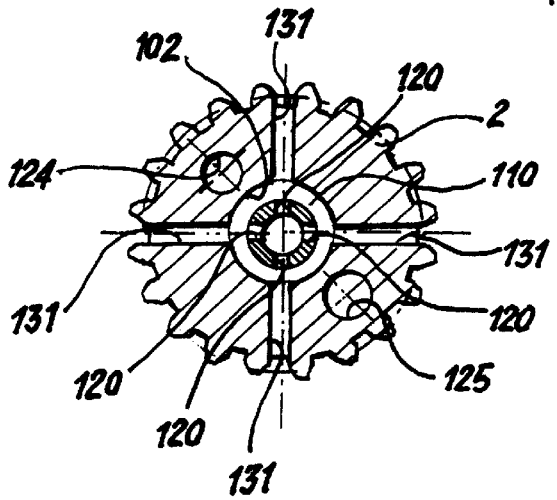
FIG. 12 is a section taken on the line XII—XII of FIG. 7.

In FIGS. 1 to 3, a phase variator formed according to the present invention is generally indicated 1.

The variator 1 is intended to be interposed between a camshaft A of an internal combustion engine and a transmission, typically of the type with a toothed belt, of which a pulley C is shown, and which drives the timing mechanism of the engine.

The phase variator 1 comprises a hub 2 bearing a threaded shank 3 which is fixed to the camshaft A by a screw coupling. An axial duct 4 extends through the hub 2 and, in use, constitutes an axial extension of a duct extending through the camshaft A for oil or supply to pressurized servo means. The duct 4 branches into several radial distribution holes 5 for performing the variation-control function which will be explained further below.

An annular piston 6 covers the hub 2, more precisely, a cylindrical portion thereof, so as to be slidable axially on the cylindrical portion of the hub. This portion has axial splines 7 jointly defining a set of straight teeth; in complementary manner, tho piston 6 has similar internal splines 8 forming a set of straight teeth complementary to and meshing with the splines 7. A predetermined clearance, the function of which will be explained below, is provided between the splines 7 and 8.

The assembly constituted by the hub 2 and the piston 6 is surrounded by a casing 9 including a generally cylindrical skirt 10 closed at one axial end by a cover 11 and open at the opposite end. The cover 11 is preferably welded to the skirt 10 by lasers. The cover 11 has a blind axial hole constituting a seat 12 housing and supporting the free end 2*a* of the hub 2. A pair of Belleville washers 15 is interposed between the base 13 of the seat 12 and the facing surface 14 of the free end 2*a* of the hub 2. Two adjacent cylindrical portions 18, 19 are identified in the skirt 10, a shoulder 20 being formed between them.

A flange 21 disposed at the base of the hub 2 is engaged sealingly in the portion 19 of the casing 9 by means of a scal 22. The hub 2 is held axially in the casing 9 with predetermined preloading of the washers 15 by a radially contractible spring ring 23 which is engaged in a respective groove in a corresponding position in the internal wall of the casing and which constitutes a shoulder for the flange 21.

A set of helical teeth 25 is formed in the portion 18 of the skirt 10. In complementary manner, the outside of the piston 6 has a first portion 26 carrying a set of helical teeth 27 meshed with the teeth 25; the piston 6 also has a second portion 28 the free end of which has a flange 29 extending radially outwardly and engaged sealingly with the portion 19 of the skirt 10 with the aid of a piston ring 30. The flange 29 has a shoulder 31 facing the shoulder 20 of the casing. The surfaces of these shoulders are normally in abutment with one another in a non-operative condition of the variator, for example, when the engine is switched off (FIG. 3).

Three ducts, indicated 32, defined between the teeth 25, 27, are spaced at angular intervals of 120°, each duct 32 being formed by the removal of a corresponding tooth from the set of teeth 25.

The casing 9 also has outer threaded holes 33 for the fixing of the pulley C by means of screws 34.

A helical spring, indicated 35, is fitted around the hub 2, its ends acting against an internal shoulder 36 of the piston 6 and against the radial flange 21 of the hub, respectively The space defined between the casing 9 and the hub 2 is divided by the piston 6 into first and second annular chambers, indicated 37 and 38 respectively, the volumes of which are variable in complementary manner. The holes 5 open Into the first chamber 37 and, as will be explained below, constitute the main supply holes for pressurized oil for the operative control of the variator. A plurality of discharge holes 39 open into the second chamber 38.

A further two holes, both indicated 40, also open in the skirt 10 of the casing 9, in its portion 18. These holes 40 will also be referred to below by the term auxiliary supply holes.

The holes 40 are in fluid communication with an oil supply flange D outside the skirt 10.

The relative positions of the holes 5, 40 are such that, when the piston 6 is in a first travel limit position shown in FIG. 1, the holes 5 and the holes 40 both open into the first chamber 37 but are disposed, respectively, adjacent to an axial end of the splines 8 and adjacent to the opposite axial end of the set of teeth 27, so that they are partially shut off by the piston 6 simultaneously but in an inversely proportional manner owing to an axial displacement thereof. It will be noted that the holes 40 are angularly offset relative to the ducts 32 so as not to open into them directly.

Similarly, the holes 39 open into the second chamber 38 behind the flange 21, but in a position such as to be partially shut off by the flange 29 when the piston 6 is in the second travel limit position shown in FIG. 2.

The operation of the variator 1 will be described below, starting from the first travel limit position of FIG. 1. In this condition, an auxiliary flow of pressurized oil is supplied through the holes 40 from the supply flange D and is admitted continuously to the first chamber 37 in a position between the set of teeth 27 and the flange 29 of the piston 6. This auxiliary oil flow is distributed in the chamber 37 by means of the ducts 32 thus flowing between the facing surfaces of the piston 6 and of the casing 9.

The pressurized oil is also discharged from the first chamber 37 through the holes 5 which, in this stage of the operation of the variator, constitute discharge holes for the auxiliary flow; the oil thus discharged is eliminated through the duct 4. It will be noted that, if the auxiliary flow discharged from the first chamber 37 through the holes 5 is greater than the flow supplied through the holes 40, the piston 6 is caused to advance towards the cover 11, thus shutting off the discharge holes 5 and freeing the holes 40 to an equal extent. As a result, there is an increase in the auxiliary flow supplied to the first chamber 37 and simultaneous decrease in the auxiliary flow discharged through the holes 5.

The flow of oil into the chamber 37 is thus regulated in a manner such that a force is exerted on the piston 6, against the opposing force exerted by the spring 35, so as to balance its effect and stop the piston 6 in a position such as to maintain a minimum distance, indicated S in FIG. 1, between the shoulders 31 and 20, preventing axial knocking between the piston and the casing.

In FIG. 2, the variator is shown in a second operative condition, with the piston 6 stopped in the second travel limit position. To reach this condition, the first chamber 37 is supplied with pressurized oil through the duct 4 and the holes 5 which, in this stage, constitute main supply holes. The piston 6 is consequently displaced axially relative to the hub 2 against the spring 35. It is pointed out that the holes 40 are shut off by the piston 6.

An auxiliary flow of pressurized oil derived from the main flow supplied to the first chamber 37 is supplied by blowby through the clearances between the splines 7, 8 to the second chamber 38, in which pressurized oil in chamber 38 generates a force on the piston 6 which is added to the force of the spring 35. The clearances between the splines 7, 8 at this stage constitutes auxiliary supply holes for the second chamber 38.

It will be noted that, when the auxiliary flow discharged from the second chamber 38 through the holes 39 is greater than the auxiliary flow supplied through the clearances of the splines 7, 8, the piston 6 is displaced towards the flange 21 of the hub, thus shutting off the discharge holes 39 with its flange 29.

As a result, there is an increase in the oil pressure in the second chamber 38 and in the corresponding force exerted on the piston 6. The discharge of the oil from the chamber 38 is thus regulated so that the force exerted on the piston 6 by the oil supplied to the first chamber 37 is balanced by the overall force exerted by the spring 35 and by the oil in the second chamber 38 so that the piston 6 is stopped with the flange 29 at a minimum distance, indicated T in FIG. 2, from the flange 21, preventing axial knocking between the piston and the hub.

Figure 6:
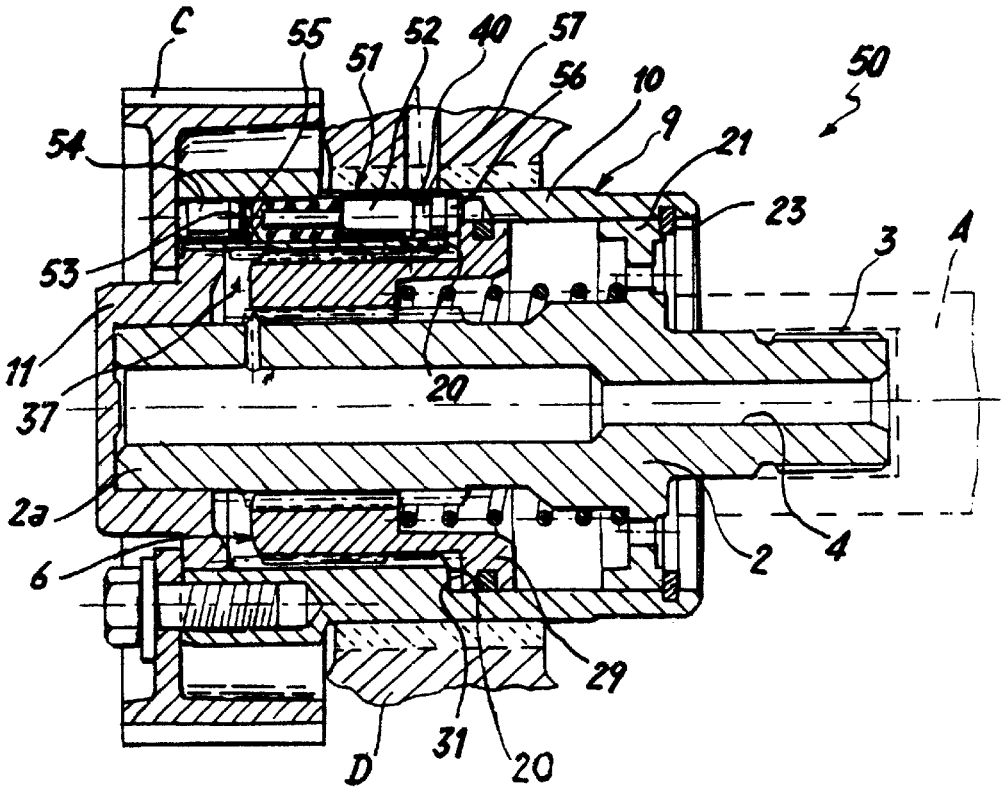
FIG. 6 is an axial section of a variant of the phase variator of the preceding drawings.

According to a variant of the invention shown in FIG. 6 and indicated 50, a valve 51 is provided for choking the auxiliary flow supplied to the first chamber 37, and includes an obturator 52 movable against a spring 55 in a valve seat 53. The seat 53 is formed in the skirt 10 of the casing 9 with its axis parallel to the axis thereof and is closed at its axial end corresponding to the cover 11 by a plug 54 whereas it is partially open at the axially opposite end adjacent the shoulder 20.

The obturator 52 is acted on by the spring 55 so that an end appendage 56 thereof projects beyond the shoulder 20 into the first chamber 37 so as to interfere with the travel of the piston 6 towards the first travel limit position. The obturator 52 also has a circumferential groove 57 located, relative to the hole 40 and to the free end of the appendage 56, in a manner such that the hole 40 is normally closed by the obturator 52 when the piston 6 has moved away from the first travel limit position and is choked by the obturator 52 when the latter is in the vicinity of the first travel limit position and shoulder 31 comes to bear against the end appendage 56.

Figure 8:
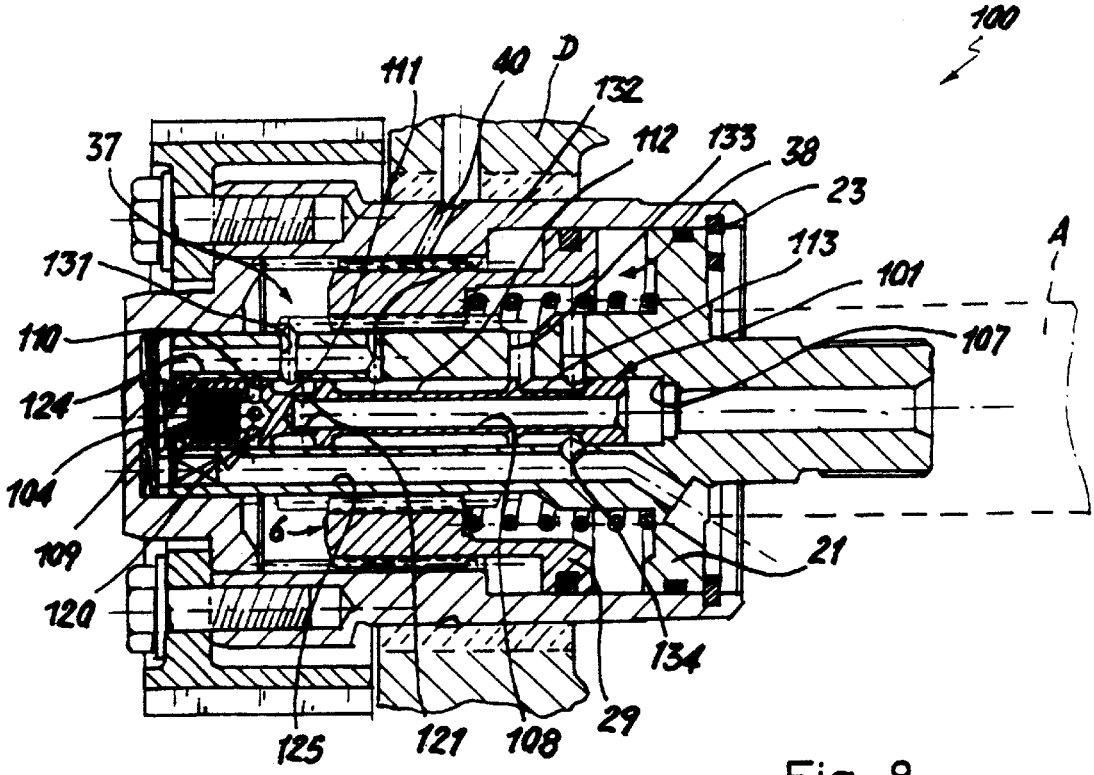
FIGS. 7, 8 and 9 are axial sections of a third embodiment of a variator according to the present invention, in different operative positions.
Figure 7:
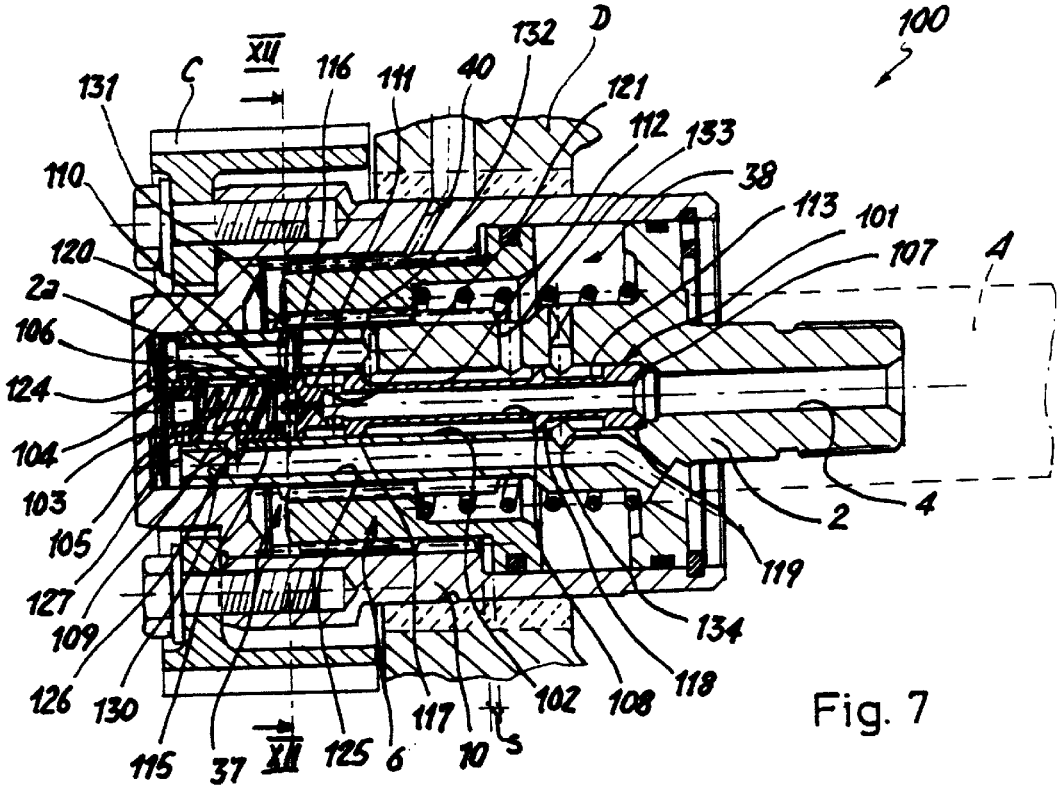

FIGS. 7 and 8 show a third embodiment of the phase variator according to the invention.

The variator is generally indicated 100 and bears the same reference numerals as the previous embodiments for similar details.

The variator 100 has a tubular distributor, generally indicated 101, movable axially in an axial seat 102 in the hub 2 and subject to the action of a spring 103. The ends of the spring 103 act, respectively, between a perforated base 104 held by a ring 105 on the free end of the hub 2, and a cup-shaped formation 106 in the facing end of the distributor 101.

The distributor 101 is therefore urged resiliently to a first operative position (FIG. 7) in abutment with a shoulder 107 of the seat 102 and is movable with a limited travel, between the shoulder 107 and the base 104.

The distributor 101 has two coaxial ducts 108, 109, both blind and extending therein from axially opposite ends. Starting from the cup-shaped formation 106, the outer skirt of the distributor 101 has first, second, third and fourth grooves 110, 111, 112, 113, spaced, respectively by first, second, third, fourth and fifth cylindrical portions 115, 116, 117, 118, 119.

A plurality of first holes 120 opening in the first groove 110 extends radially through the distributor 101 from the duct 109. A second plurality of holes 121 opening in the second groove 111 extends radially from the duct 108.

Both of two parallel ducts 124, 125 extend axially in the hub 2 from the end 2*a* The duct 125 is partially closed at the end 2*a* by a plug 126 having a calibrated hole 127.

First, second, third, fourth and fifth radial holes, indicated 130, 131, 132, 133, 134, respectively, starting from the end 2*a*, are also formed in the hub.

Both of the first and fifth holes 130, 134 extend between the axial seat 102 in the distributor 101 and the duct 125, which is also indicated as the discharge duct.

The second hole or series of holes 131 opens between the seat 102 and the first chamber 37 behind the splines 7; these holes correspond to the holes 5 of the previous embodiment, perform the same function, and are distributed radially so as not to shut off the duct 124.

The third hole 132 extends radially through the hub 2 from the axial seat 102 and intersects the duct 124.

The fourth hole 133 extends radially through the hub 2 from the seat 102 and opens in the second chamber 38 behind the splines 7.

The operation of the variator 100, when the piston 6 is in the first travel limit position of FIG. 7, is just like that of the variators 1, 50 of the previous embodiments.

At this stage, the distributor 101 is urged by the spring 103 into a position in abutment with the shoulder 107. In this position, the holes 131 are put by the distributor 101 into fluid communication with the discharge duct 125 by means of the groove 110, the holes 120, the duct 109 and the holes 130. The oil discharged from the chamber 37 is consequently eliminated through the duct 125. The flow of oil to the chamber 37 is regulated by the simultaneous choking of the holes 131, 40, as in the variator of the previous embodiments, so that the piston 6 is stopped in the first travel limit position, maintaining the minimum distance S between the shoulders 20, 31.

Figure 9:
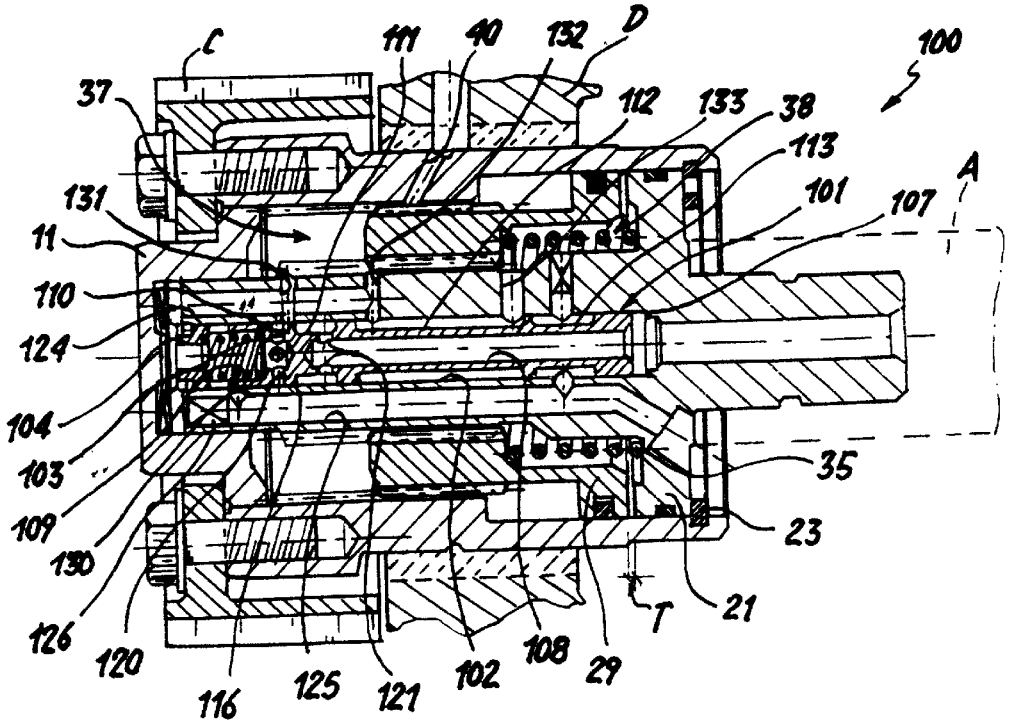

In FIG. 9, the variator 100 is shown in a second operative position, in which the piston 6 is stopped in the second travel limit position.

To reach this position, a main oil flow is supplied from the duct 4 through the axial duct 108 of the distributor 101. The latter is moved by the force of the pressurized oil, against the spring 103, towards and operative position in which it abuts the base 104 (FIG. 8). In this position, the duct 108 is put into fluid communication with the holes 131 through the holes 121 and the groove 111.

The main oil flow therefore flows from the duct 108 to the first chamber 37 so that the piston 6 is displaced axially relative to the hub 2 against the spring 35. It will be noted that, at this stage, the second chamber 38 is connected to the discharge duct 125 through the holes 133, the groove 113 and the holes 134. Moreover, during the travel of the piston towards the second travel limit position, the auxiliary supply holes 40 are shut off by the piston.

In the second travel limit position, the holes 132 are freed by the piston 6 so that the pressurized oil is discharged from the chamber 37 and flows, through the duct 124, to the second axial duct 109 of the distributor 101, exerting a force on the distributor in the same direction as the spring 103. The discharge holes 130 are shut off by the first cylindrical portion 115 of the distributor 101.

The distributor 101 is consequently displaced towards the shoulder 107, choking the main supply holes 131 with its portion 115. The force generated by the oil pressure supplied through the duct 124 to the duct 109 constitutes means for biasing the distributor 101.

The reduction in the main flow supplied to the chamber 37 causes the piston 6 to advance towards the cover 11, thus shutting off the holes 132 and opening the holes 131 to an equal extent, as a result of the displacement of the distributor 101 towards the base 104. The flow of oil into the chamber 37 is regulated by the simultaneous choking of the supply and discharge flows in the chamber 37 so that the piston 6 is stopped in the second travel limit position with the minimum distance T between the flanges 21 and 29 (FIG. 9).

It should be pointed out that, in the second travel limit position, the second chamber 38 is preferably in fluid communication with the first chamber 37 through the hole 132, the groove 112 and the hole 133. As well as flowing into the duct 109, some of the oil discharged through the hole 132 therefore also flows into the chamber 38, where it exerts a force on the piston in the same direction as the spring 35. These forces are balanced by the hydraulic force exerted on the piston in the first chamber 37.

When the main pressurized-oil supply to the chamber 37 stops and the pressure in the duct 4, 108 is consequently reduced below a threshold value, the distributor 101 is repositioned in the position of FIG. 7, connecting the first chamber 37 directly to the discharge by the discharge duct 125 through the holes 131, 120 and 130. This avoids the oil discharged having to flow back along the main supply duct 4.

Figure 10:
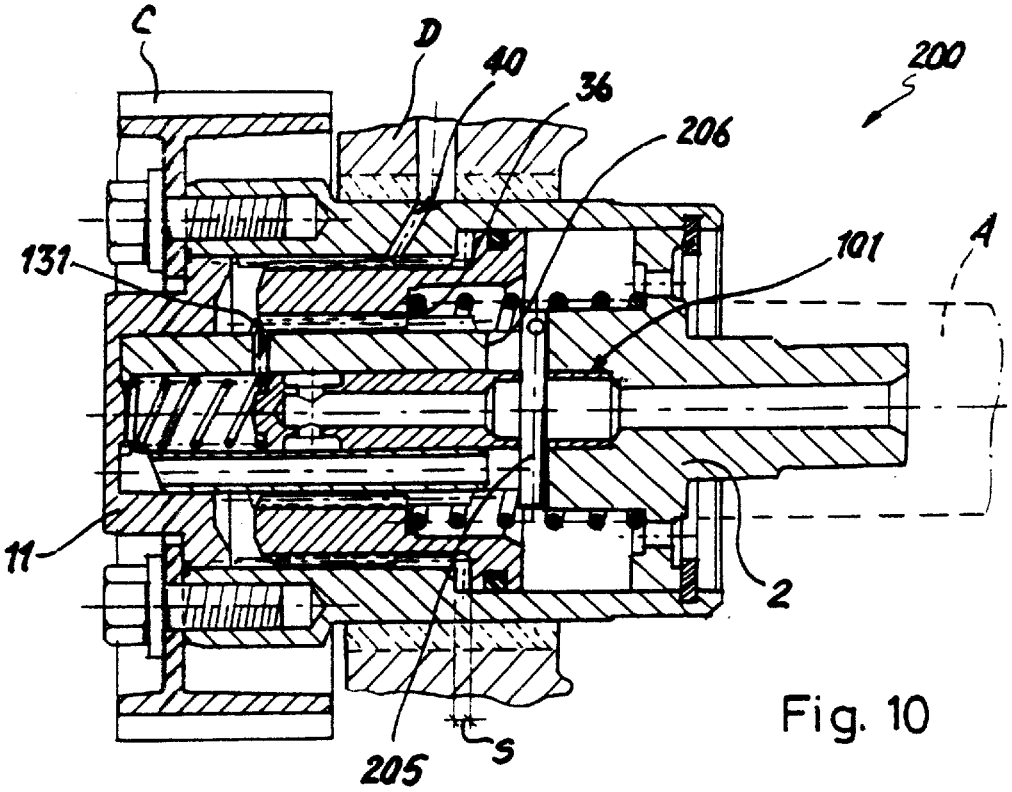
FIGS. 10 and 11 are axial sections of a variant of the variator of FIG. 7 in the operative positions corresponding to those of FIGS. 7 and 9.
Figure 11:
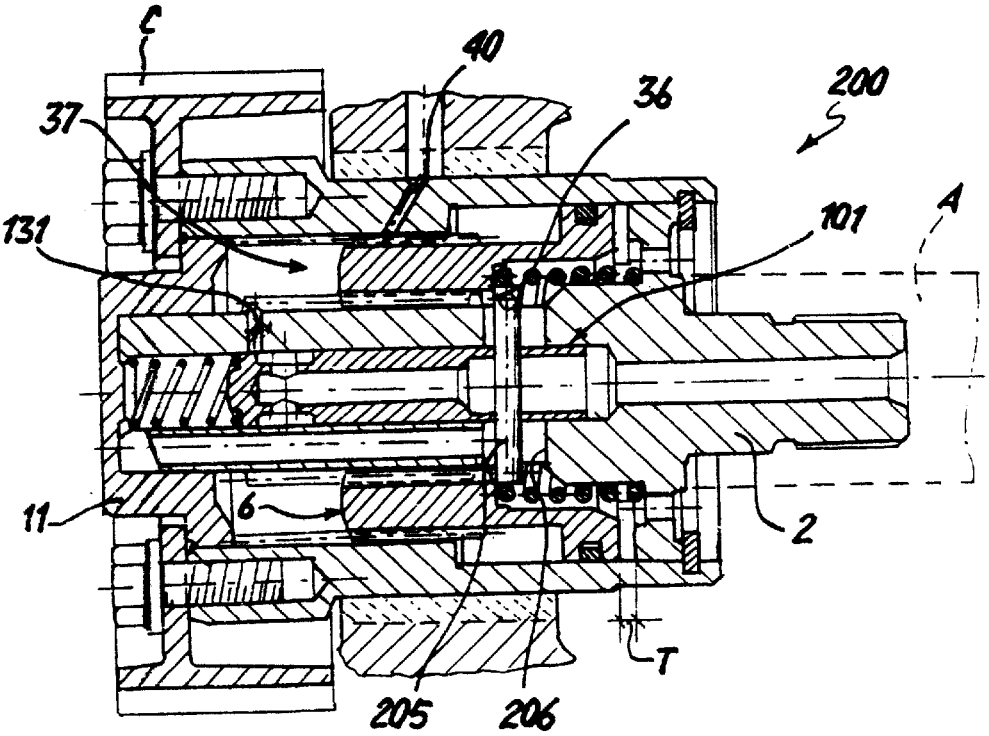

FIGS. 10 and 11 show a further embodiment of the variator of the invention, generally indicated 200. This embodiment differs from the variator 100 in that the means for biasing the distributor 101 towards the position in which the hole 131 is choked comprise a pin 205 which extends through a radial slotted hole 206 in the hub 2 and is fixed in the distributor 101. The opposite ends of the pin 205 project from the hub 2 so as to constitute an abutment surface for the shoulder 36 of the piston 6 and to intercept the piston during its travel towards the second travel limit position and consequently to bias the distributor 101 towards a position in which the main supply hole is partially shut off.

The invention thus solves the problem set, achieving numerous advantages in comparison with known solutions.

A first advantage lies in the fact that a cushion of pressurized oil is maintained between the piston and the axial abutment surfaces in the travel limit positions, eliminating axial knocking and consequently limiting the noise of the variator.

A second advantage lies in the fact that the piston is stopped by the supply to the variator of an auxiliary flow which is limited in comparison with the main flow and supplied independently thereof.

Another advantage is constituted by the fact that the variator of the invention improves the control of the positioning of the piston substantially independently of the temperature (and consequently the viscosity) of the oil used as the actuating servo means. In fact, the choking of the delivery of oil as well as—possibly—the discharge of oil from the first chamber, stops the piston, irrespective of the fact that increased viscosity of the oil when the engine is cold slows the outward flow of the oil through the discharge hole. Conversely, when the oil is hot, the choking of the discharge hole from the first chamber prevents excessive discharge of oil, which has low viscosity, the stopping of the piston also being improved as a result of greater opening of the supply holes.

Moreover, the piston returns sufficiently quickly from the second travel limit position to the first position, owing to the fact that, when the auxiliary supply hole is shut off, the auxiliary supply flow to the first chamber is almost completely suppressed until the piston is close to the first travel limit position.

With regard to the stopping of the piston in the second travel limit position, it is pointed out that axial knocking in this position starts mainly when the engine is hot when the oil pressure and viscosity are particularly low; optimal use is made of this low viscosity to supply the auxiliary oil flow into the second chamber through the clearances between the meshed teeth of the hub and of the piston.

Moreover, with specific reference to the third embodiment of the invention, owing to the ample and direct hydraulic connection which connects the two chambers in the position of FIG. 9 through the third and fourth holes as well as the second groove, there is a rapid flow of oil into the second chamber in order to stop the piston in the second travel limit position (without the delays connected with the blowby of oil through the clearances of the teeth), as well as faster return of the piston towards the first travel limit position owing to the rapid discharge of the oil from the first chamber and its transfer directly into the second chamber. This avoids the need Lo cause the oil directed to the discharge to flow back along the main supply duct, with consequent slowing of the piston.

Finally, the structure of the variator according to the second embodiment achieves optimal shutting-off of the auxiliary supply hole so that there is no flow of oil into the first chamber which could delay the travel of the piston towards the first travel limit position.

Finally, as well as limiting axial knocking, the constant presence of oil inside the variator helps to limit its general noisiness due to various effects such as circumferential knocking.

What is claimed is:

1. A phase variator, for varying a phase relationship between a shaft and a transmission associated with the shaft, comprising:

a hub adapted to be fixed for rotation with the shaft, a casing adapted to be fixed for rotation with the transmission, an annular space defined between the casing and the hub, an annular piston mounted in said annular space and with said hub and said casing defining first and second chambers on opposite_sides of the piston for receiving pressurized fluid, supply means for supplying a flow of the pressurized fluid, said annular piston extending circumferentially around the hub and translatable axially on the hub, said annular piston being adapted to move in said annular space as a result of said flow of pressurized fluid into the first chamber to apply a moving force to said annular piston and means in said second chamber for providing an opposing force to said moving force, coupling means arranged between the hub and the annular piston as well as between the annular piston and the casing for bringing about a variation of a phase relationship of the hub and the casing as a result of axial movement of the piston relative to the hub; and automated stop means for stopping the piston so as to avoid axial end contact of the piston and the casing characterized in that the stop means comprise valve means for choking the flow of pressurized fluid into said first chamber, wherein said supply means comprise means for supplying a main flow of said pressurized fluid and separate means for supplying an auxiliary flow of the pressurized fluid into the first chamber.

2. A variator according to claim 1, in which the means for supplying an auxiliary flow comprises at least one auxiliary supply hole and said valve means comprises an obturator which can choke the auxiliary supply hole in order to choke the auxiliary flow into the first chamber.

3. A variator according to claim 2, in which the auxiliary supply hole opens through the casing.

4. A variator according to claim 2, wherein the stop means comprises at least one auxiliary discharge hole for discharging pressurized fluid from the first chamber and means for choking the auxiliary discharge hole simultaneously with and in inverse proportion to the choking of the auxiliary supply hole.

5. A variator according to claim 4, in which the means for choking the auxiliary discharge hole is constituted by a portion of the piston.

6. A variator according to claim 5, in which the auxiliary supply hole and auxiliary discharge hole open into said first chamber at axially opposite ends of said portion of the piston when said piston is in a first travel limit position.

7. A variator according to claim 6, in which internal ducts are provided in at least one of the piston and the casing for putting the auxiliary supply hole and auxiliary discharge hole in fluid communication.

8. A variator according to claim 2, in which said obturator is constituted by a portion of the piston.

9. A variator according to claim 8, in which the auxiliary supply hole opens in the first chamber in a position such that said auxiliary supply hole is partially shut off by the portion of the piston constituting said obturator when the piston is in a first travel limit position.

10. A variator according to claim 2, in which the obturator has an appendage arranged so as to engage the piston in order to displace the obturator from a position in which the auxiliary supply hole is shut off towards a position in which the auxiliary supply hole is choked when the piston is in a first travel limit position.

11. A variator according to claim 1, in which an auxiliary supply flow into the second chamber is achieved by a flow from the first chamber.

12. A variator according to claim 11, in which the auxiliary supply flow into the second chamber is by blowby between the piston and the hub.

13. A variator according to claim 1, further comprising a distributor mounted in a seat in the hub, the seat being divided by the distributor into a first portion and a second portion which are capable of being in fluid communication, respectively, with said means for supplying a main flow of the pressurized fluid and with a discharge duct, the distributor being movable in the seat in order to choke a main supply hole for providing the flow of the pressurized fluid into the first chamber by connection of the first portion with the means for supplying a main flow of the pressurized fluid, and distributor biasing means for urging the distributor towards a position in which the main supply hole is shut off by the distributor.

14. A variator according to claim 13, in which the distributor biasing means comprises an abutment surface on the distributor, extending so as to engage the the piston so that the distributor is displaced to the position in which the main supply hole is shut off when the piston is in a travel limit position.

15. A variator according to claim 13, in which the forces exerted on the distributor are constituted by the distributor biasing means and a hydraulic force created by said means for supplying a main flow of the pressurized fluid.

16. A variator according to claim 13, in which the distributor biasing means comprises a transfer duct extending between a discharge hole from the first chamber and the second portion of the seat.

17. A phase variator, for varying a phase relationship between a shaft and a transmission associated with the shaft, comprising:

a hub adapted to be fixed for rotation with the shaft;

a casing adapted to be fixed for rotation with the transmission;

an annular space defined between the casing and the hub;

an annular piston mounted in said annular space and with said hub and said casing defining at least one chamber for pressurized fluid;

supply means for supplying a flow of the pressurized fluid into said at least one chamber;

said annular piston extending circumferentially around the hub, being translatable axially on said hub, and being adapted to move in said annular space as a result of said flow into the at least one chamber;

coupling means arranged between the hub and the annular piston as well as between the annular piston and the casing for bringing about a variation of a phase relationship of the hub and the casing as a result of axial movement of the piston relative to the hub; and stop means for controlling the fluid in said at least one chamber so as to avoid axial end contact of the piston and casing and the axial end contact of the piston and the hub.

* * * * *